US010804589B1

(12) United States Patent
Rivera

(10) Patent No.: US 10,804,589 B1
(45) Date of Patent: Oct. 13, 2020

(54) PARALLEL PLATE ANTENNA WITH VERTICAL POLARIZATION

(71) Applicant: The United States of America as represented by the Secretary of the Navy, Newport, RI (US)

(72) Inventor: David F Rivera, Westerly, RI (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 16/527,369

(22) Filed: Jul. 31, 2019

(51) Int. Cl.
*H01Q 1/12* (2006.01)
*H01Q 1/36* (2006.01)
*H01Q 1/20* (2006.01)

(52) U.S. Cl.
CPC ..... *H01Q 1/1207* (2013.01); *H01Q 1/20* (2013.01); *H01Q 1/36* (2013.01)

(58) Field of Classification Search
CPC ..... H01Q 1/12; H01Q 1/1207; H01Q 1/1242; H01Q 1/125; H01Q 1/1264; H01Q 1/20; H01Q 1/42; H01Q 1/0407
See application file for complete search history.

(56) References Cited

U.S. PATENT DOCUMENTS

| | | | | |
|---|---|---|---|---|
| 8,228,243 | B1 * | 7/2012 | Rivera | H01Q 1/48 343/702 |
| 10,511,087 | B1 * | 12/2019 | Rivera | H01Q 9/0407 |
| 2005/0248499 | A1 * | 11/2005 | Park | H01Q 21/205 343/895 |
| 2008/0191711 | A1 * | 8/2008 | Rivera | G01N 22/00 324/629 |
| 2010/0090924 | A1 * | 4/2010 | Honda | H01Q 1/36 343/872 |

* cited by examiner

*Primary Examiner* — Seokjin Kim
(74) *Attorney, Agent, or Firm* — James M. Kasischke; Michael P. Stanley

(57) ABSTRACT

An antenna is provided with conducting plates spaced apart from each other and the base to be in vertical alignment. A cross-shaped support extends perpendicular from a front section of the base to secure the conducting plates. An arm of the support indents to accommodate a conducting plate. A J-shaped support is fastened to a rear planar section of the base with extensions extending perpendicular to secure the conducting plates. A first conducting plate is J-shaped with a bend facing a width edge. A second conducting plate is also J-shaped with the plane of the plate perpendicular to the base and spaced apart from the first conducting plate. A third conducting plate is U-shaped and integral with an L-shaped section with a bend of the U-shape facing the width edge. The short leg of the L-shape section attached in the indentation of the cross-shaped support.

2 Claims, 9 Drawing Sheets

PARALLEL PLATE ANTENNA WITH VERTICAL POLARIZATION

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention relates generally to antennas, and more particularly to a parallel plate antenna.

(2) Description of the Prior Art

Presently, electrically short antennas are used in receive-only applications. As such, there is a continuing need for a compact antenna with practical transmitting and receiving capabilities. Such a compact antenna could be used on platforms including unmanned aerial or undersea vehicles.

SUMMARY OF THE INVENTION

It is therefore a primary object and a general purpose of the present invention to provide a compact antenna.

It is a further purpose of the present invention to provide a compact antenna capable of radiating a vertically polarized wave.

To attain the objects of the present invention, an antenna is provided in which size compaction of the antenna is facilitated by an arrangement of three conducting plates vertically spaced apart and in alignment with each other on a vertical axis. The antenna includes a rectangular base to support the conducting plates.

In the invention, a cross-shaped support is affixed to a front planar section of the base and extending perpendicular therefrom. The cross-shaped support secures the conducting plates at multiple points of each plate. The support has an indentation in an arm of the cross in which the indentation is sized to accommodate a section of one of the conducting plates.

A J-shaped second support is fastened to a rear planar section of the base at a bend of the J-shape with adjacent portions of the support extending perpendicular therefrom to allow the conducting plates to be secured to the support. The cross-shaped support and the J-shaped support are spaced apart between the lengths of the base in regard to their attachment to the base. The conducting plates are secured to the supports in order to position planar sections of each plate to be perpendicular to the base as well as properly spaced apart from each other.

A first conducting plate is J-shaped with a planar bend of the J-shape facing a width edge of the base. A long extension of the J-shape of the plate is secured to the long extension of the J-shaped second support. Remaining sections of the conducting plate are secured to the arms of the cross-shaped support. The conducting plate is spaced apart from and perpendicular to the base.

A second conducting plate is also J-shaped. The long extension of the J-shape of the plate is secured to a short extension of the J-shaped second support. The long extension as well as the remaining sections of the second conducting plate are secured at the arms of the cross-shaped support. The plane of the second conducting plate is perpendicular to the base and is spaced apart from the first conducting plate.

A third conducting plate is U-shaped and integral with a L-shaped section with a bend of the U-shape facing the base width. The short leg of the L-shape is integral to a first end of the U-shape of the conducting plate. The long leg of the L-shape is attached in the slot of the cross-shaped support. A second end of the U-shape is fastened to the long extension of the J-shaped second support. The remaining sections of the third conducting plate are secured to the cross-shaped support.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
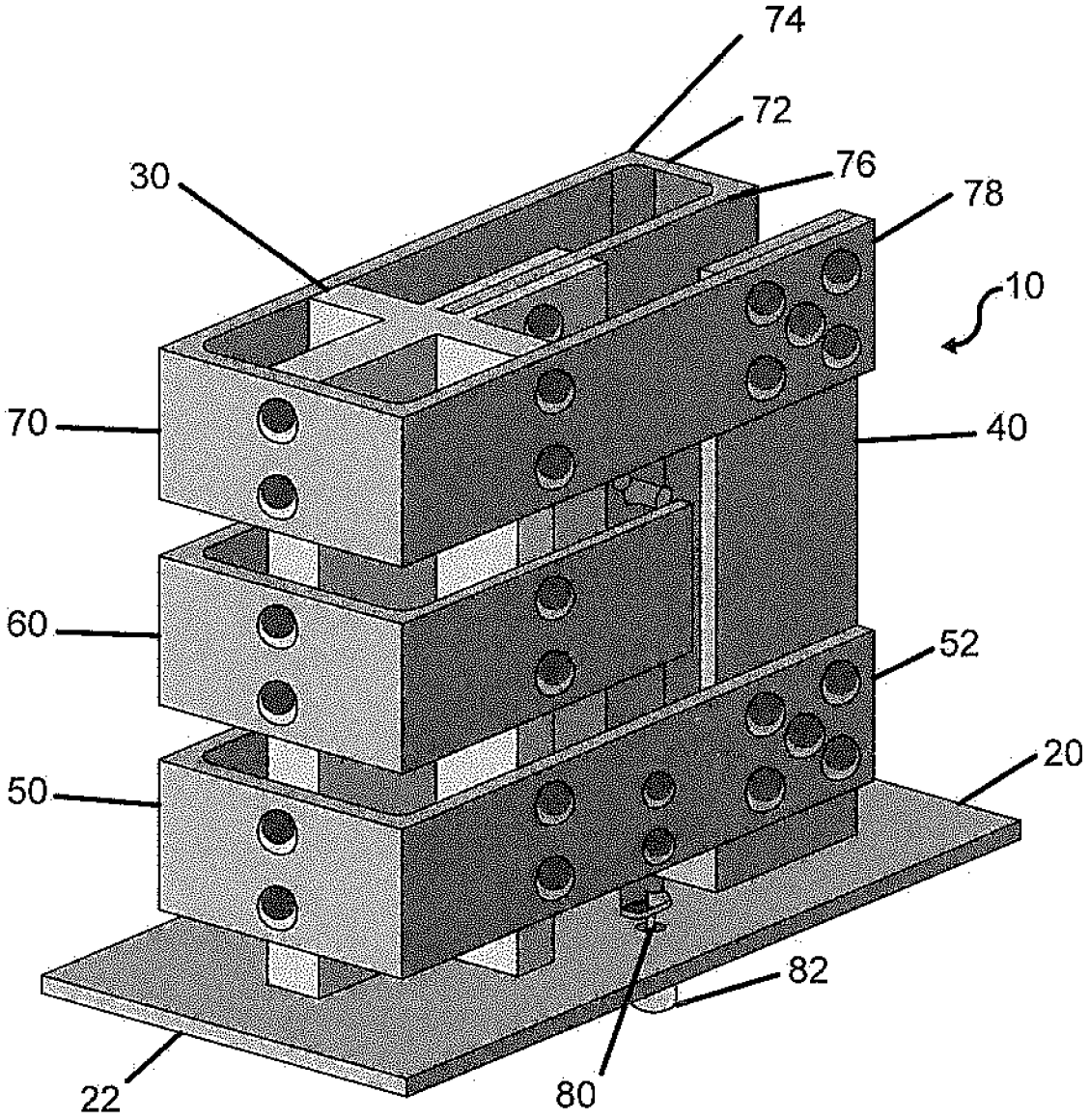
FIG. 1 is a perspective view of a parallel plate antenna in accordance with an embodiment of the present invention.

Referring now to the drawings, FIG. 1 depicts a parallel plate antenna in accordance with an embodiment of the present invention shown and referenced by numeral 10. In the illustrated embodiment, three parallel conducting plates of the antenna are shown. However, it is to be understood that an antenna in accordance with the present invention could be constructed with additional conducting plates without departing from the scope of the present invention.

Generally, the various parts of antenna 10 are electrically conductive. Electrical conductivity can be achieved by using solid metals and metal-coated non-conductive substrates for the various parts without departing from the scope of the present invention.

As shown in FIG. 1, the antenna 10 includes a conductive rectangular base 20 having a length, a thickness and a width.

Figure 2:
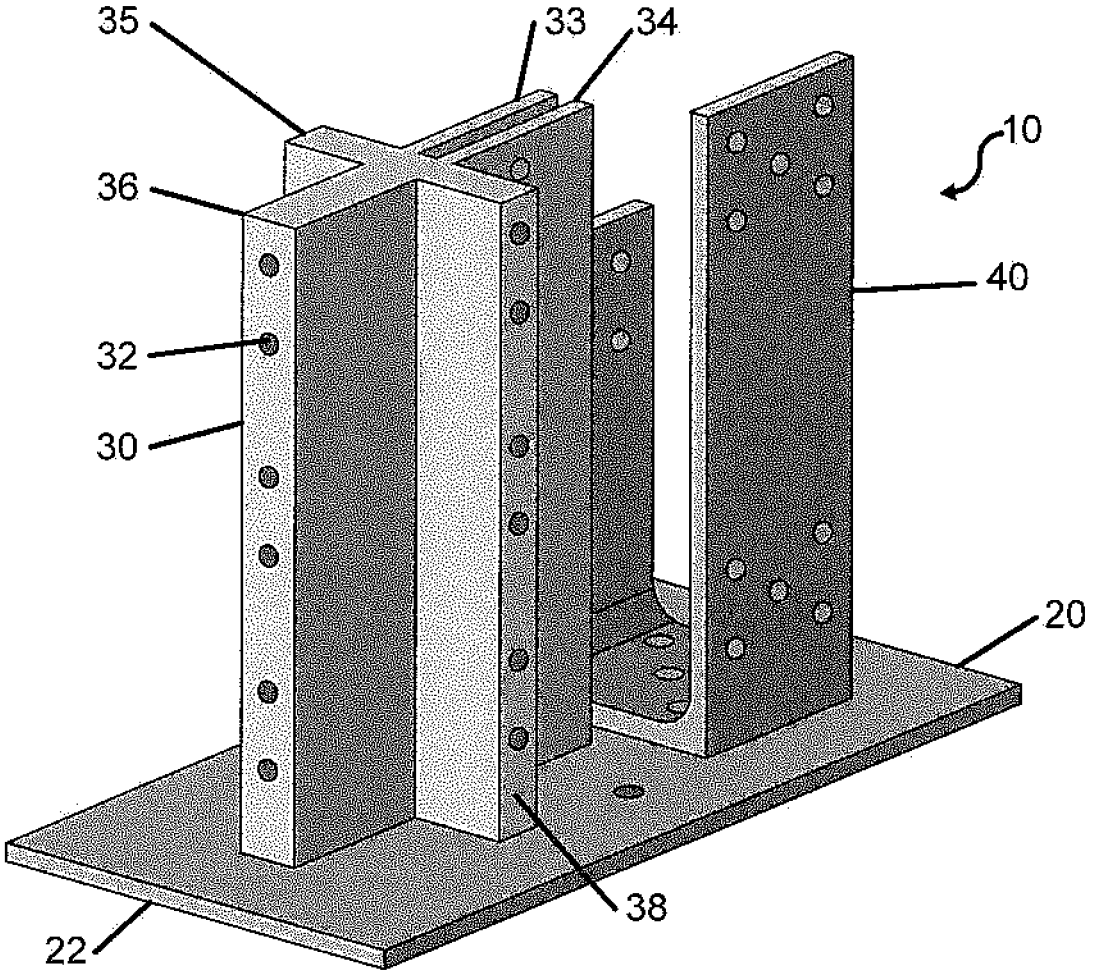
FIG. 2 is a perspective view of an elongated cross-shaped support and a J-shaped support positioned on the base of the antenna of the present invention.

As shown in FIG. 2, a non-conductive elongated cross-shaped support 30 is mechanically fastened to a front planar section of the base 20 and extending perpendicular therefrom. As also shown in the figure and in FIG. 3, a conductive J-shaped second support 40 is mechanically fastened to a rear planar section of the base 20 and extending perpendicular therefrom.

By the use of numerous fastener indentations 32 with appropriately sized fasteners (not shown), the cross-shaped support 30 is capable of securing a first conducting plate 50, a second conducting plate 60 and a third conducting plate 70 at multiple points of each plate. The cross-shaped support 30 also has a first arm 33 with an elongated indentation 34 or slot in which the indentation can accommodate a section of the third conducting plate 70 by being oversized compared to a vertical thickness of the plate.

The J-shaped second support 40 is mechanically fastened to a rear planar section of the base 20 at a bend of the J-shape with adjacent portions of the second support extending perpendicular therefrom to mechanically secure the first conducting plate 50, the second conducting plate 60 and the third conducting plate 70. The first support 30 and the second support 40 are spaced apart from one another along the length of the base 20 in regard to their attachment to the base.

The first conducting plate 50, the second conducting plate 60 and the third conducting plate 70 are secured to the first support 30 and the second support 40 in order to position planar sections of each plate to be perpendicular to the base 20 as well as properly spaced apart from each other. The base 20, the second support 40, and the plates are electrically conductive. The first support 30 is non-conductive.

The size compaction of the antenna 10 is achieved by the arrangement of the first conducting plate 50, the second conducting plate 60 and the third conducting plate 70 spaced apart vertically and in alignment with each other.

Figure 4:
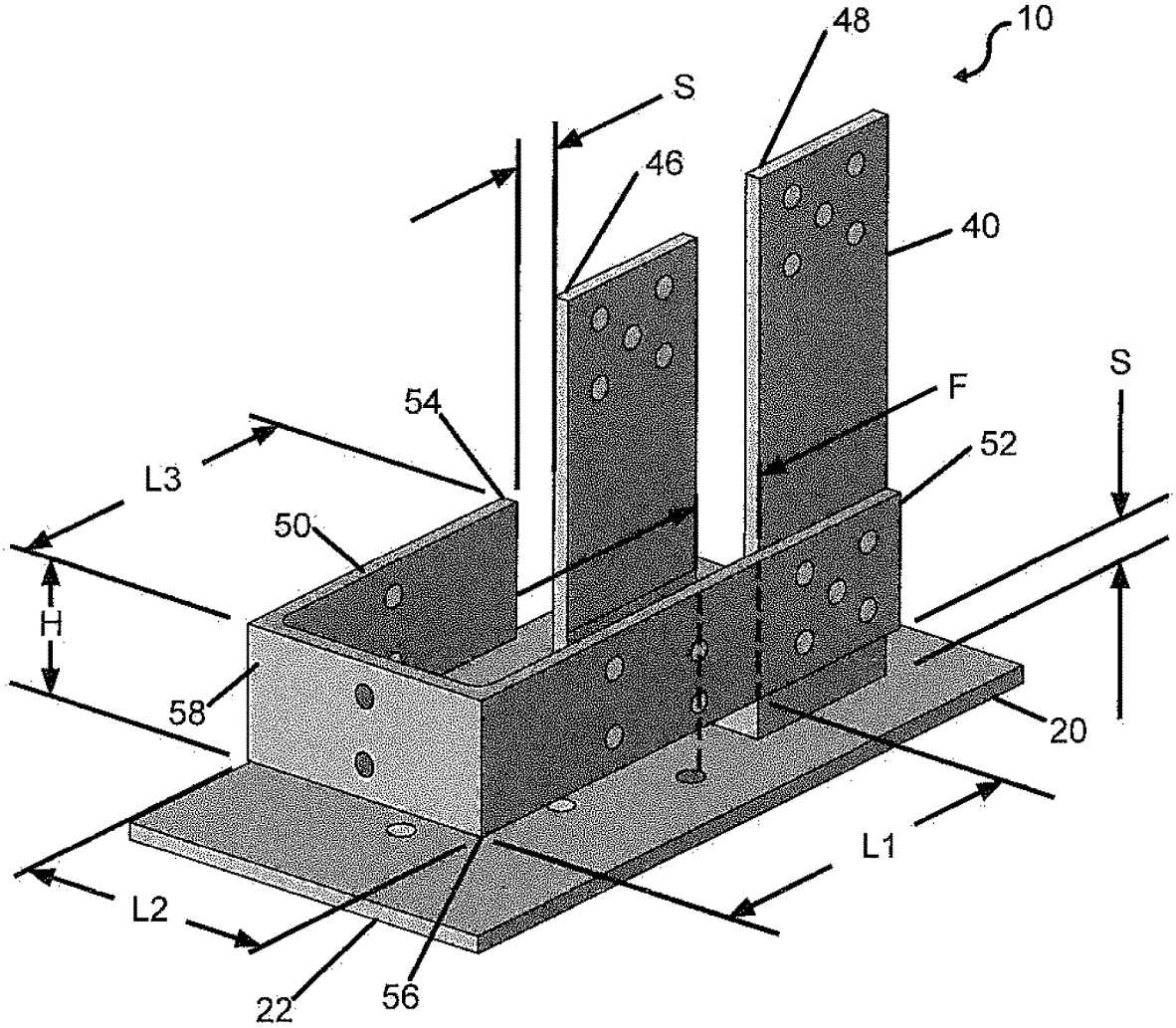
FIG. 4 is a perspective view of a first conducting plate positioned on the J-shaped support.

As shown in FIG. 4, the first conducting plate 50 of the three conducting plates is J-shaped with a planar bend of the J-shape facing a first edge 22 of the base at the width. A first end 52 at a long extension of the J-shape of the first conducting plate 50 is secured to a portion of the long extension of the J-shaped second support 40 in proximity to the bend of the J-shape. The remaining sections of the J-shape of the first conducting plate 50 are mechanically secured to an end of a second arm 35, a third arm 36 and a fourth arm 38 of the cross-shaped support 30. The plane of the first conducting plate 50 is spaced apart from and perpendicular to the base 20.

Figure 5:
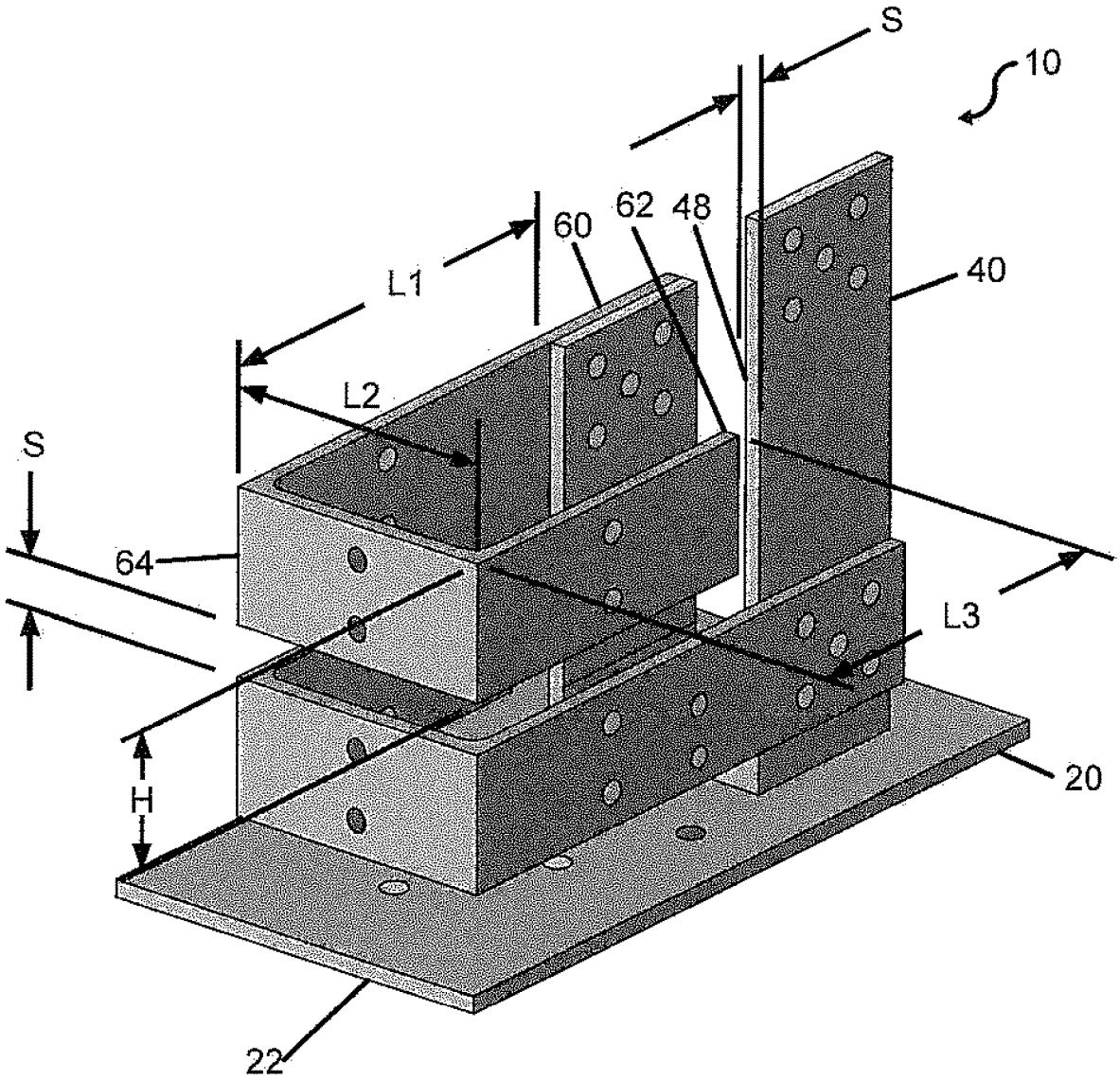
FIG. 5 is a perspective view of a second conducting plate positioned on the J-shaped support.

As shown in FIG. 5, the second conducting plate 60 of the three conducting plates is J-shaped. The plane of the long extension of the J-shape of the second conducting plate 60 angularly faces and is in parallel with a plane of the long extension of the J-shape of the first conducting plate 50. The long extension of the J-shape of the second conducting plate 60 is secured in proximity to an end of a short extension of the J-shaped second support 40. The long extension as well as the remaining sections of the second conducting plate 60 are secured at the end of the second arm 35, the third arm 36 and the fourth arm 38 of the cross-shaped support 30. The plane of the second conducting plate 60 is perpendicular to the base 20 and is spaced apart from the first conducting plate 50.

Figure 6:
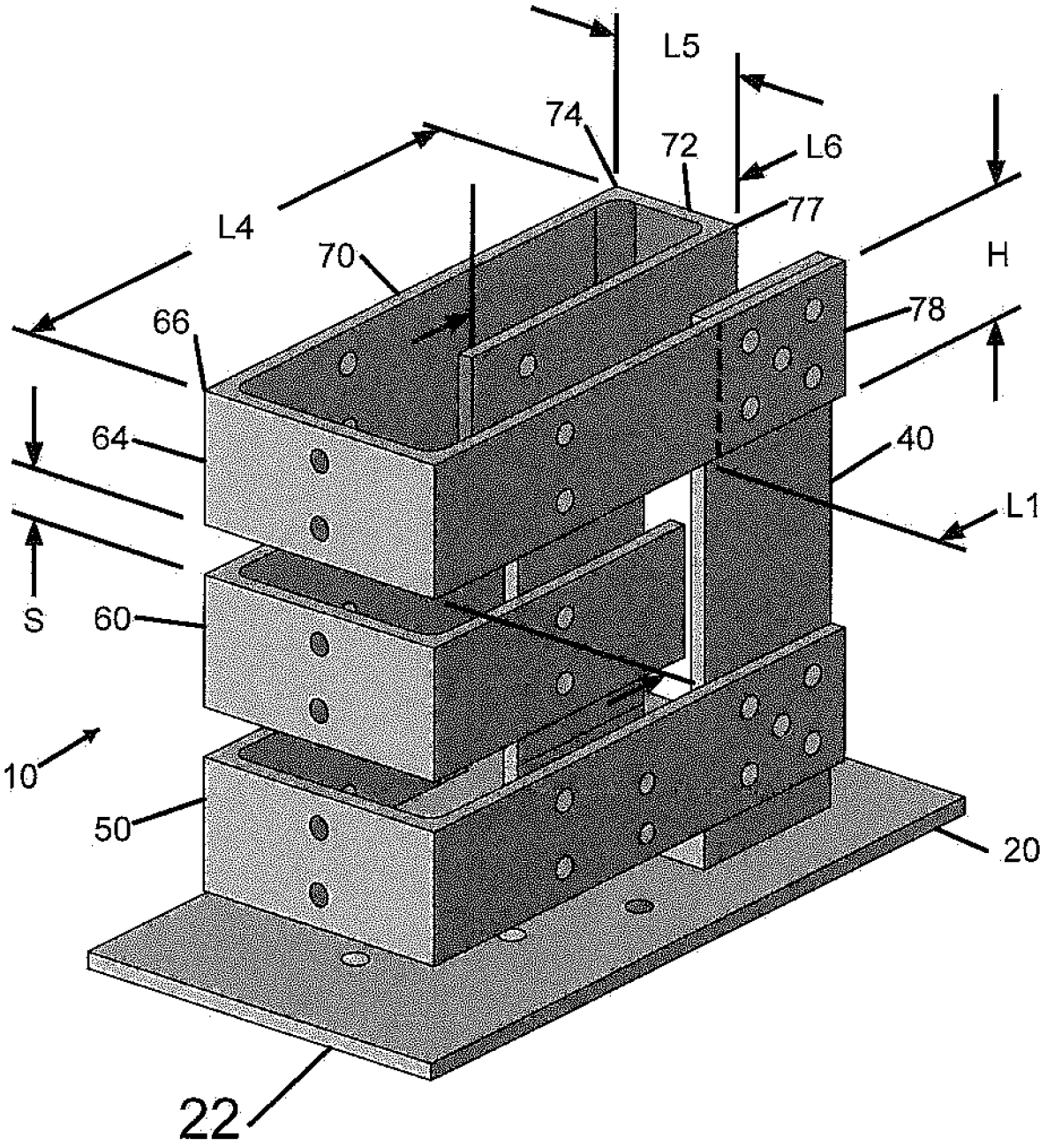
FIG. 6 is a perspective view of a third conducting plate positioned on the J-shaped support.

As shown in FIG. 6, the third conducting plate 70 of the three conducting plates is U-shaped and integral with an L-shaped section facing the first width edge 22. A short leg 72 of the L-shape is integral to an edge 74 of the U-shape of the third conducting plate 70. A long leg 76 of the L-shape is positioned inward and mechanically attached in the slot 34 of the cross-shaped support 30. A second end 78 of the U-shape of the third conducting plate 70 is mechanically fastened in proximity to an end of the long extension of the J-shaped second support 40. The remaining sections of the third conducting plate 70 are secured at the end of the second arm 35, the third arm 36 and the fourth arm 38 of the cross-shaped support 30.

The antenna 10 can be cast as a single structural element or can be assembled from individual elements by welding without departing from the scope of the present invention. The base 20 also serves as an attachment point at a feed point connection 80 for an electrical ground plane 82 for the antenna 10. The feed point connection 80 must be adjusted accordingly to obtain a good impedance match at a fundamental frequency.

Dimensions of the antenna 10 are expressed as a fraction of a fundamental operating wavelength λ, calculated in Equation (1) as:

$$\lambda = \frac{v_o}{f} \tag{1}$$

where $v_o$ is the speed of light and f is the operating frequency, Hz.

Figure 3:
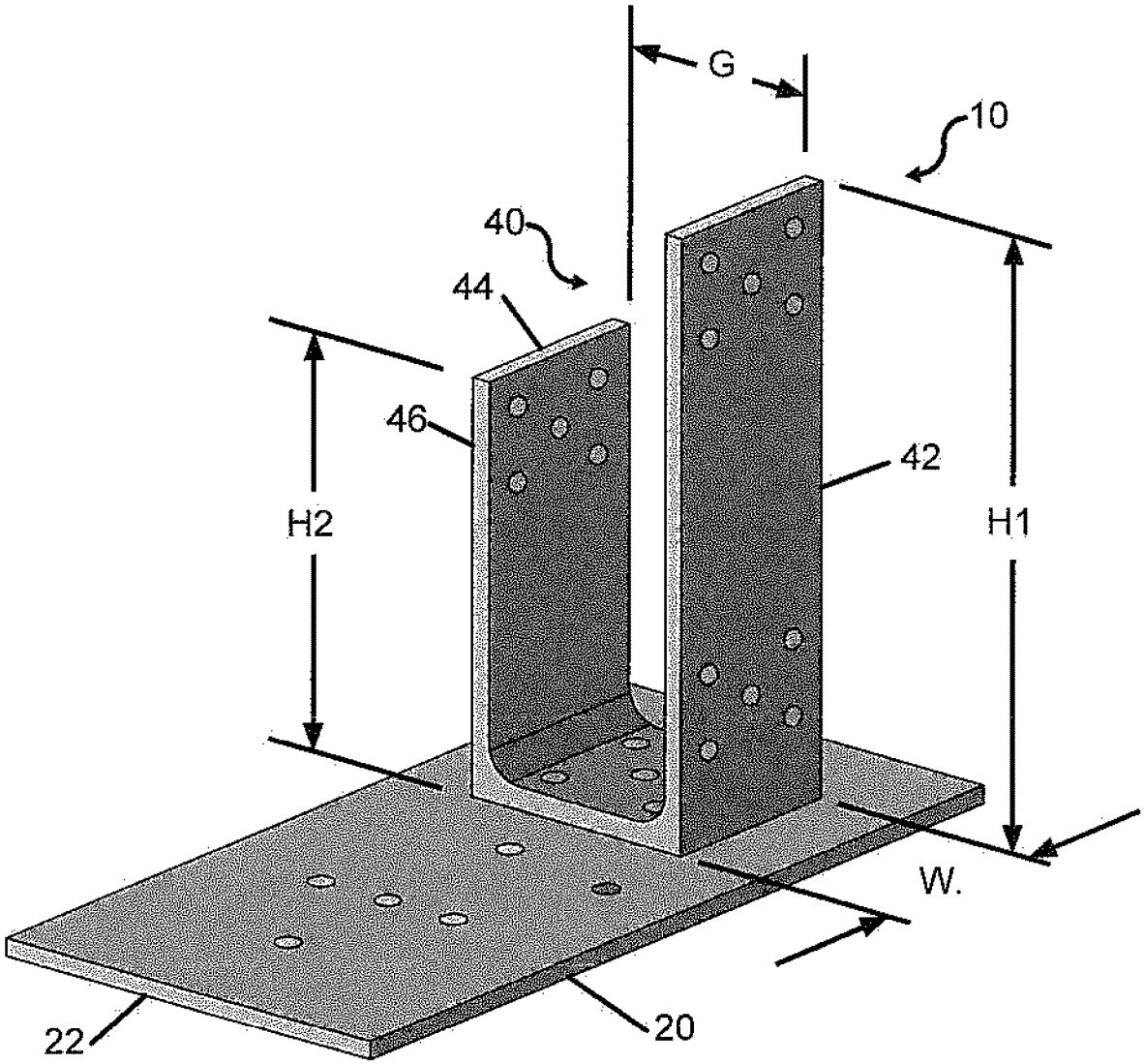
FIG. 3 is a perspective view of the J-shaped support positioned on the base.

Starting with FIG. 3, the U-shaped channel of the second support 40 is dimensioned with a height (H1) of λ/16 for a first or long extension 42 (vertical support) with a U-channel width (W) of λ/48. A second or short extension 44 (vertical support) is dimensioned with a height (H2) of λ/24 spaced apart at a distance (G) of λ/44 from the first extension 42.

In FIG. 4, the first conducting plate 50 is positioned for attachment to the second support 40. The first conducting plate 50 is positioned at a distance (S) of λ/175 from the base 20. This distance (S) is also the distance from an end 54 of the short extension of the first conducting plate 50 to a forward edge 46 of the second support 40. The feed point location 80 is located at a distance (F) of λ/66 from a forward edge 48 of the long extension 42 of the second support 40.

The length (L2) of the bend of the first conducting plate 50 is λ/33. The height (H) of the conducting plate 50 is λ/69 with (L1) being the distance of λ/21 from a bend edge 56 to the forward edge 48 of the long extension 42 of the second support 40. (L3) is the length λ/24 from a bend edge 58 to the end 54 of the first conducting plate 50.

In FIG. 5, the second conducting plate 60 is positioned for attachment to the second support 40. The second conducting plate 60 is dimensioned with a height (H) of λ/69. The second conducting plate 60 has a distance (S) of λ/175 from the first conducting plate 50. The distance (S) is also a distance from the forward edge 48 of the second support 40 to an end 62 of the second conducting plate 60. (L1) is a distance λ/21 from an edge 64 of the second conducting plate 60 to the forward edge 46 of the second support 40. (L2) is a width λ/33 of the bend of the second conducting plate 60. (L3) is a length λ/24 of a short extension of the second conducting plate 60.

In FIG. 6, the third conducting plate 70 is positioned for attachment to the second support 40. The third conducting plate 60 is dimensioned with a height (H) of λ/69. The third conducting plate 70 has a distance (S) of λ/175 from the second conducting plate 60. (L1) is a distance λ/21 from an edge of a bend 64 of the third conducting plate 70 to the forward edge 48 of the second support 40. (L4) is a distance λ/15 from another edge 66 to the edge 74 of the third conducting plate 70. (L5) is a distance λ/66 from the edge 74 to the edge 77 of the third conducting plate 70. (L6) is a distance λ/23 from the edge 77 to the end opposite to the end 78 of the third conducting plate 70.

Figure 7:
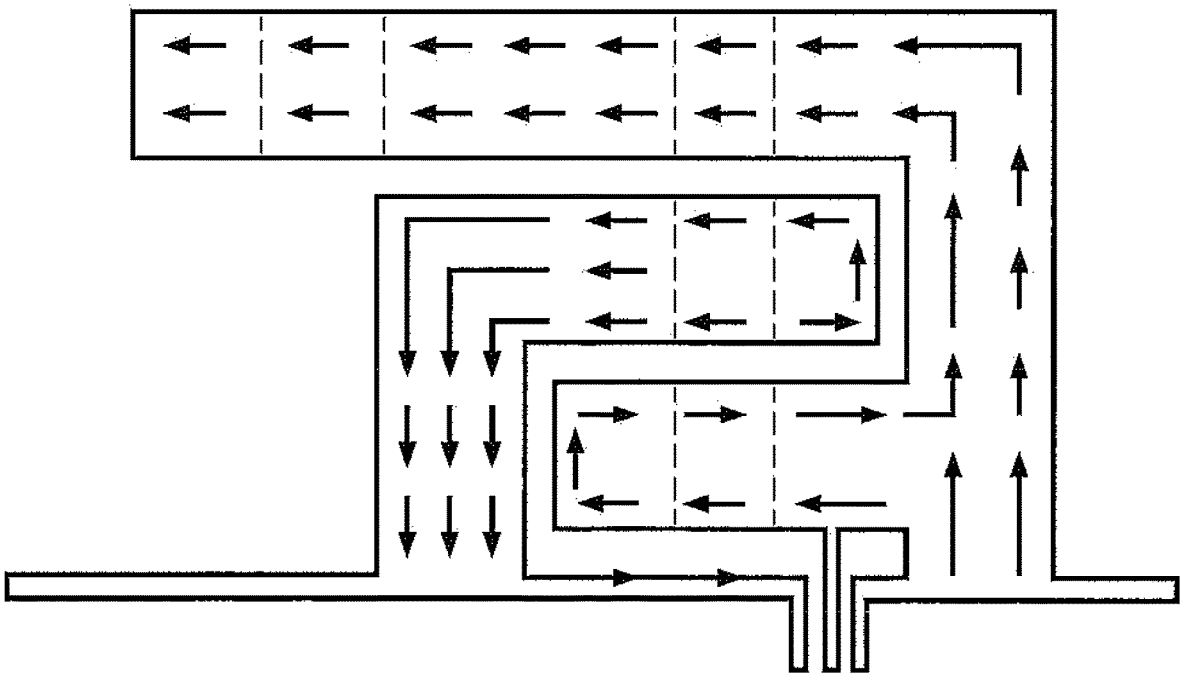
FIG. 7 depicts a resonance established by a first frequency with current flow shown in conductive paths formed by the conducting plates of the antenna of the present invention.
Figure 8:
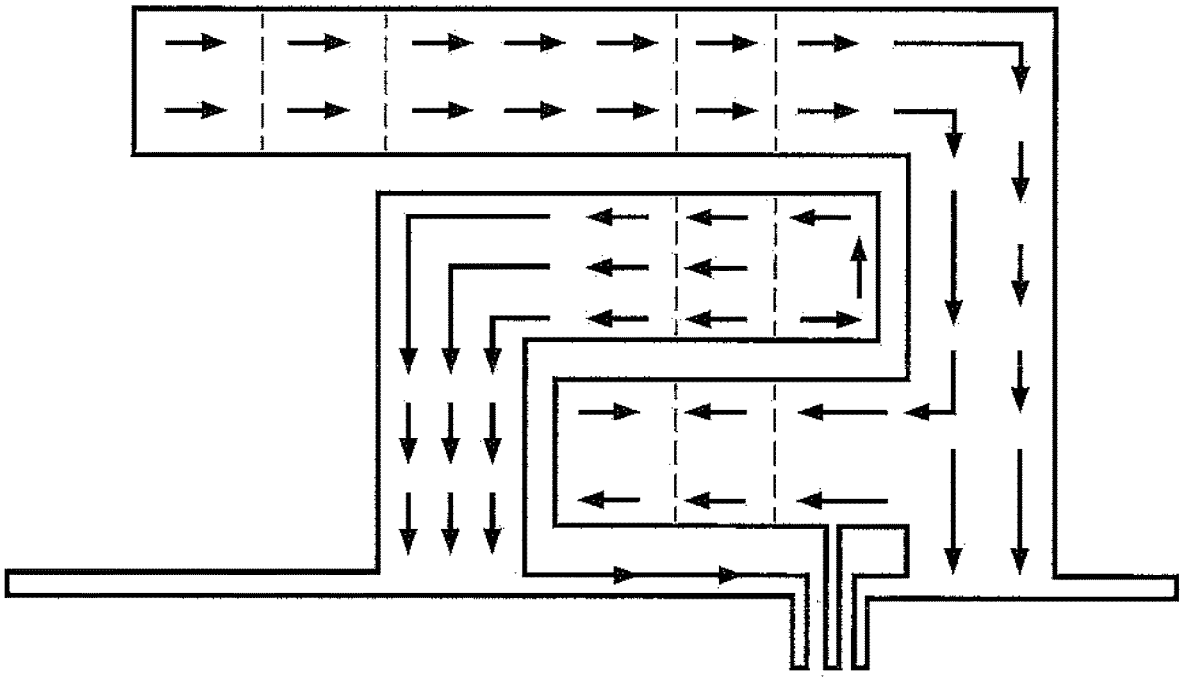
FIG. 8 depicts a resonance established by a second frequency with current flow shown in conductive paths formed by the conducting plates.
Figure 9:
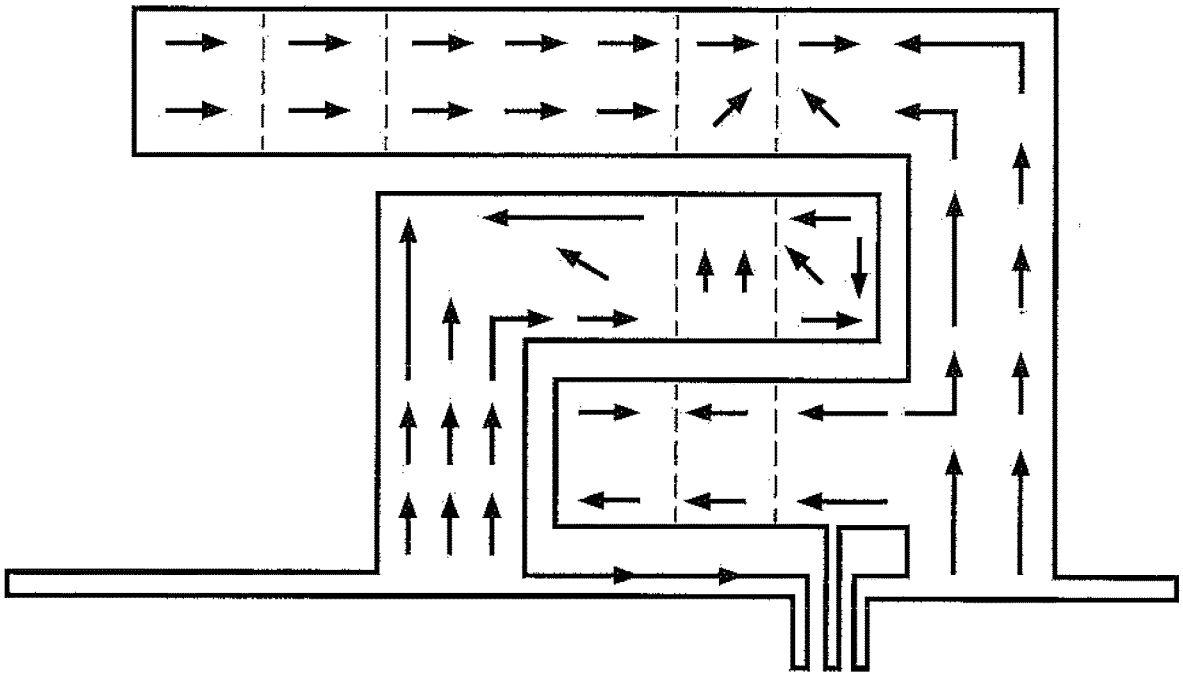
FIG. 9 depicts a resonance established by a third frequency with current flow shown in conductive paths formed by the conducting plates.

The antenna 10 has vertical polarization due to a net direction of electric current flow on the surface of the conducting plates. This is best depicted as an unfurling of the antenna 10 into a flat antenna as shown in FIG. 7, FIG. 8 and FIG. 9 where dotted lines are the locations of where the antenna 10 is bent. When a feed is energized, current flow is established through the conductive paths formed by the plates. The direction of current on the surface of the conducting plates changes with frequency.

In FIG. 7, a current path at a first resonance is shown. In FIG. 8, a current path at a second resonance is shown in which the resonance is 1.6 times the first resonance. In FIG. 9, a current path at a third resonance is shown in which the resonance is 2.1 times the first resonance.

Despite the changes in current distribution, the radiation patterns maintain a similar shape (up to the third resonance at least). This likely occurs because currents traveling in opposite directions in the adjacent plates cancel the local radiated fields; thereby producing a net radiated field with vertical polarization.

It will be understood that many additional changes in the details, materials, steps and arrangement of parts, which have been herein described and illustrated in order to explain the nature of the invention, may be made by those skilled in the art within the principle and scope of the expressed in the appended claims.

What is claimed is:

1. A parallel plate antenna comprising:

a rectangular base having a length, a thickness and a width;

a feed point connection within said base wherein said feed point connection is sized to accommodate an electrical ground plane for said antenna;

an elongated cross-shaped support fastened to a front planar section of said base and extending perpendicular therefrom, said cross-shaped support having a first arm with an elongated indentation and said cross-shaped support having a second arm, a third arm and a fourth arm;

a J-shaped support with a short extension and long extension, said J-shaped support spaced apart from said cross-shaped support and fastened to a rear planar section of said base at a bend of the J-shape with adjacent portions of said second support extending perpendicular therefrom;

a first J-shaped conducting plate with a short extension and a long extension, said first conducting plate spaced apart from and perpendicular to said base with a planar bend of the J-shape facing a first edge of said base at a width, a first end of the long extension of the J-shape of said first conducting plate secured to a portion of the long extension of said J-shaped support in proximity to a bend of said J-shaped support with remaining sections of the J-shape of said first conducting plate secured to an end of the second arm, the third arm and the fourth arm of said cross-shaped support;

a second J-shaped conducting plate with a short extension and a long extension, the long extension of the J-shape secured in proximity to an end of the short extension of said J-shaped support wherein a plane of the long extension of the J-shape of said second conducting plate angularly faces and is in parallel with a plane of the long extension of the J-shape of said first conducting plate with the plane of said second conducting plate perpendicular to said base and spaced apart from said first conducting plate, the long extension as well as remaining sections of said second conducting plate secured at the end of the second arm, the third arm and the fourth arm of said cross-shaped support; and a third conducting plate with a first end and a second end, said third conducting plate being U-shaped and integral with an L-shaped section facing the first edge of said base at a width with a short leg of the L-shape integral to a rear bend above the rear planar section of said base with a long leg of the L-shape secured inward and in the elongated indentation of said cross-shaped support with a first end of said third conducting plate fastened in proximity to an end of the long extension of said J-shaped support, remaining sections of said third conducting plate secured at the end of the second arm, the third arm and the fourth arm of said cross-shaped support.

2. The antenna in accordance with claim 1 wherein dimensions of said antenna are expressed as a fraction of a fundamental operating wavelength λ, calculated as $$\lambda = \frac{v_o}{f}$$

where $v_o$ is the speed of light and f is an operating frequency, Hz;

said J-shaped support dimensioned with a height of λ/16 for the long extension with a U-channel width of λ/48 and the short extension with a height of λ/24 spaced apart at a distance of λ/44 from the long extension;

said first conducting plate positioned at a distance of λ/175 from said base with a distance λ/175 from an end of the short extension of said first conducting plate to a forward edge of said J-shaped support, a length of a bend of said first conducting plate being λ/33 and a height of said first conducting plate being λ/69 with a distance of λ/21 from a bend edge on the same side of said plate and to a forward edge of the long extension of said J-shaped support with λ/24 being a length of the short extension of said first conducting plate;

said feed point location at a distance of λ/66 from the forward edge of the long extension of said J-shaped support;

said second conducting plate dimensioned with a height of λ/69 at a perpendicular distance of λ/175 from said first conducting plate with λ/175 also a distance from the forward edge of said J-shaped support to an end of the short extension of said second conducting plate wherein λ/21 is a distance from an edge at a bend of said second conducting plate to the forward edge of the short extension of said J-shaped support with a width λ/33 of the bend with length λ/24 of a short extension of said second conducting plate; and said third conducting plate dimensioned with a height of λ/69 spaced at a distance of λ/175 from said second conducting plate with a distance λ/21 from an edge of a front bend of said third conducting plate above the front planar section of said base to the forward edge of the long extension of said J-shaped support and a distance λ/15 from another edge of the front bend of said third conducting plate to an end of a short leg of the L-shaped section of said third conducting plate above the rear planar section of said base with a distance λ/66 to another end of the short leg and a distance λ/23 from the another end of the short leg to the second end of the third conducting plate.

* * * * *